United States Patent [19]

Svenning et al.

[11] Patent Number: 4,913,590

[45] Date of Patent: Apr. 3, 1990

[54] MONO-ATMOSPHERIC CHAMBER

[75] Inventors: Bjørnar Svenning, Trondheim; Per Brevig, Hommelvik, both of Norway

[73] Assignee: Den norske stats oljeselskap a.s, Norway

[21] Appl. No.: 143,139

[22] PCT Filed: May 6, 1987

[86] PCT No.: PCT/NO87/00033

§ 371 Date: Jan. 5, 1988

§ 102(e) Date: Jan. 5, 1988

[87] PCT Pub. No.: WO87/06906

PCT Pub. Date: Nov. 19, 1987

[51] Int. Cl.[4] ..... B63C 11/40

[52] U.S. Cl. ..... 405/188; 405/192; 405/195; 166/356

[58] Field of Search ..... 405/189, 188, 203, 204, 405/192, 185; 166/356

[56] References Cited

U.S. PATENT DOCUMENTS 1,008,301 11/1911 Baker ..... 405/189

3,643,736 2/1972 Talley, Jr. ..... 166/356

4,256,417 3/1981 Bohannon ..... 405/203 X 4,753,552 6/1988 Karal et al. ..... 405/189

FOREIGN PATENT DOCUMENTS 2024293 1/1980 United Kingdom ..... 405/204

*Primary Examiner*—Dennis L. Taylor

*Assistant Examiner*—J. Russell McBee

*Attorney, Agent, or Firm*—Lucas & Just

[57] ABSTRACT

A mono-atmospheric chamber module for placing on the top of a Christmas tree (1) in a well-head, to keep equipment and personnel at surface conditions during the execution of varied well operations. The chamber module comprises a mainly oblong cylindrical mantle (4) with associated base-ends. An opening (7) for tight engagement with the top of the Christmas tree (1) is arranged in the lower base-end (5). The upper base-end (6) is detachable. Inside the module, a pressure resistant personnel chamber (14) is arranged with direct connection to an access opening (19) placed in the cylinder mantle (4).

7 Claims, 5 Drawing Sheets

MONO-ATMOSPHERIC CHAMBER

TECHNICAL FIELD

The invention relates to a mono-atmospheric chamber module for placing on top of an underwater "Christmas tree" in a well-head, to keep equipment and personnel at surface conditions during execution of operations and including an opening arranged for tight engagement with the top of the Christmas tree and an access opening for personnel.

DISCLOSURE OF INVENTION

The invention aims at providing a chamber which can be arranged for tight engagement with the top of a Christmas tree, in which chamber mono-atmospheric conditions can be maintained, whereby personnel can stay inside the chamber, in order to execute various maintenance operations. In particular one is aiming at providing such a mono-atmospheric chamber which provides increased safety for personnel and which is suitable for the reception of equipment necessary for the execution of maintenance operations. Such equipment can for example be a blow-out preventer, which is placed on the top of the Christmas tree when required, a wire sluice, which is employed during down well operations, a tubing drum with coiled-up tubing for establishing a circulation path in the production hole, without using the annular space, a sluice for the insertion of equipment, for example a plug, under the Christmas tree by means of smoothly polished rods ("polished rod" technique), etc. The chamber is able to be placed in sealing engagement with the top of the Christmas tree without the use of securing means. The chamber shall also provide additional safety for personnel in the case of pressure build-up inside the chamber as a result of leakage from the well.

According to the invention a mono-atmospheric chamber module as initially mentioned is proposed, which chamber module is characterized by being made up of an assembly of a predominantly oblong cylindrical mantle and associated base-ends, where the opening facing the top of the Christmas tree is arranged in the lower base-end, where the upper base-end is unlocked, and where inside the chamber module a pressure resistant personnel chamber is arranged with direct connection to the access opening which is placed in the cylinder mantle.

Since the chamber module is made up of a principally oblong cylindrical mantle and associated base-ends, the chamber module can be designed as a relatively tall and slim module which will provide sufficient and desirable space for the necessary maintenance equipment, for example a wire sluice. Vertical erection of the cylindrical chamber module is made possible by the opening facing the top of the Christmas tree being arranged at one of the base-ends, that is the lower base-end when the chamber module is positioned on the top of the Christmas tree.

Since the upper base-end is unsecured, a high degree of security against harmful pressure build-up inside the chamber module is achieved. The upper base-end normally rests in a sealed manner against the cylinder mantle's adjacent end, by action of the water pressure. In the case of an internal pressure build-up, the upper base-end will raise itself, immediately revealing a large release-opening.

Since there is a pressure resistant personnel chamber arranged inside the module, having a direct connection with the access opening situated in the cylinder mantle, extra security for personnel is achieved, because personnel will be able to stay inside the personnel chamber and perform from there the desired steering/control functions. The personnel chamber is thus also utilized as a control chamber. When necessary, personnel can leave the personnel chamber by way of suitable hatches, and enter the rest of the module. Naturally the required barriers for shutting off the valves in the Christmas tree have been established in advance.

The upper loose base-end is preferably designed with a cylindrical wall extension stretching downwards on the outside of the cylinder mantle. Thus, a guiding of the upper base-end in relation to the cylinder mantle is achieved.

During transportation and placing of the new chamber module, the loose, upper base-end can be locked to the cylinder mantle by means of a suitable locking device. This locking device is released as soon as the chamber module is placed on the Christmas tree and the personnel enter the personnel chamber.

There is preferably an opening placed in the base-end facing the top of the Christmas tree, which opening is surrounded by a sealing collar intended for tight engagement with a supporting part designed on the top of the Christmas tree. The chamber module is supplied with ballast in order to achieve the desired sealing contact. When the chamber module is placed under atmospheric internal pressure, the hydrostatic pressure will keep the chamber module securely in place virtually in an unfastened manner, i.e. without the use of special securing means.

The mentioned supporting part is preferably designed as a cup. Thus, access to the top of the Christmas tree from inside the chamber module's room is facilitated.

The control chamber preferably comprises a cylinder segment of the module and is designed with a central, through-going passage which forms a connection between module rooms above and underneath the personnel chamber. The advantage of this is that the personnel chamber is made an integral part of the chamber module and the maintenance equipment in use achieves a central location since the opening facing the top of the Christmas tree is also centered round the chamber module's vertical central line.

The compartment under the personnel chamber is preferably designed to accommodate a blow-out preventer, and the compartment above the personnel chamber is preferably designed to accommodate equipment for the execution of desired operations.

BRIEF DESCRIPTION OF DRAWINGS

The invention shall be explained in more detail by referring to the drawings, where.

MODES FOR CARRYING OUT THE INVENTION

Figure 1:
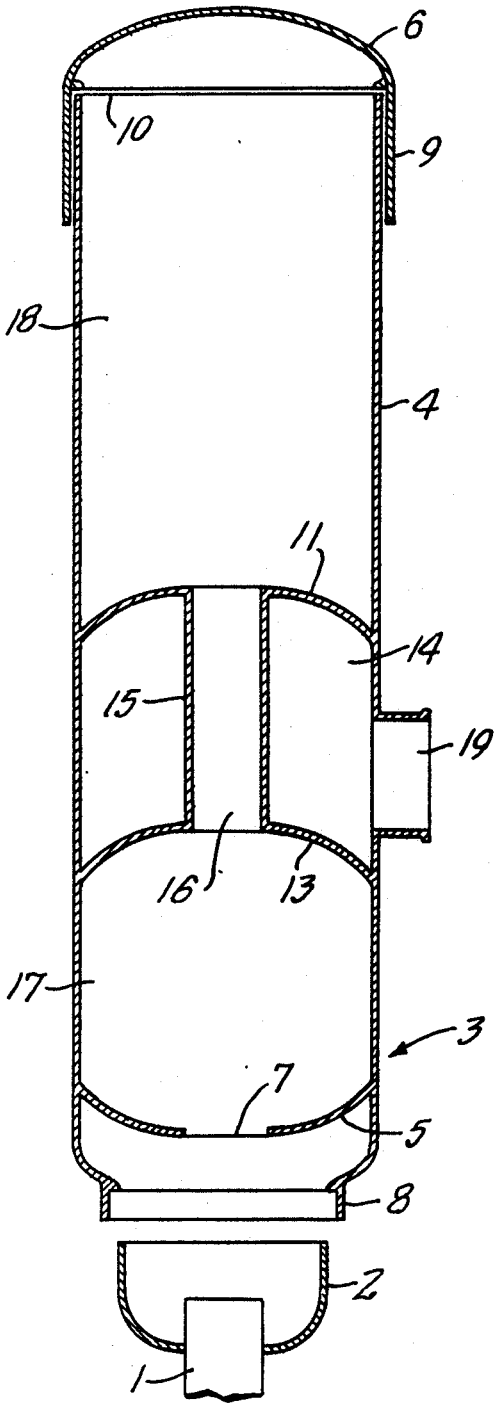
FIG. 1 shows purely schematically the structure of the new monoatmospheric chamber module.

In FIG. 1 there is shown at the bottom, a Christmas tree 1 with a supporting part 2 which is cup-formed, welded onto it. Above this a chamber module 3 is shown. This chamber module is built up of a cylinder mantle 4, a lower base-end 5 and a loose, upper base-end 6.

In the lower base-end 5 there is an opening 7. Around this opening 7 a sealing collar 8 is arranged and is intended for sealing co-operation with the cup-formed supporting part 2.

The upper, loose base-end 6 has a cylindrical wall extension 9 which extends downwards on the outside of the cylinder mantle 4. The base-end 6 is designed with a circumscribing internal resting surface 10 for sealing engagement against the cylinder mantle's upper edge.

Inside the chamber module 3, an annular personnel chamber 14 is arranged by means of two base-ends 11 and 13. This personnel chamber has the cylinder mantle 4 at its outer circumference and a pipe-element 15 at its inner boundary. The ring-formed personnel chamber 14 constitutes an integrated part of the chamber module and has a central through-running passage 16 which provides a link between the module's rooms 17 and 18 beneath and above the personnel chamber 14.

In the part of the cylinder mantle 4 which constitutes the outer wall in the personnel chamber 14, an access opening 19 is arranged for personnel. In the personnel chamber's ceiling and floor, which are formed by the shown base-ends 11 and 13, a respective hatch (not shown in FIG. 1) is arranged, through which personnel can gain admittance to the rooms 18 and 17.

The access opening 19 can naturally be closed by means of a not shown hatch.

Figure 2:
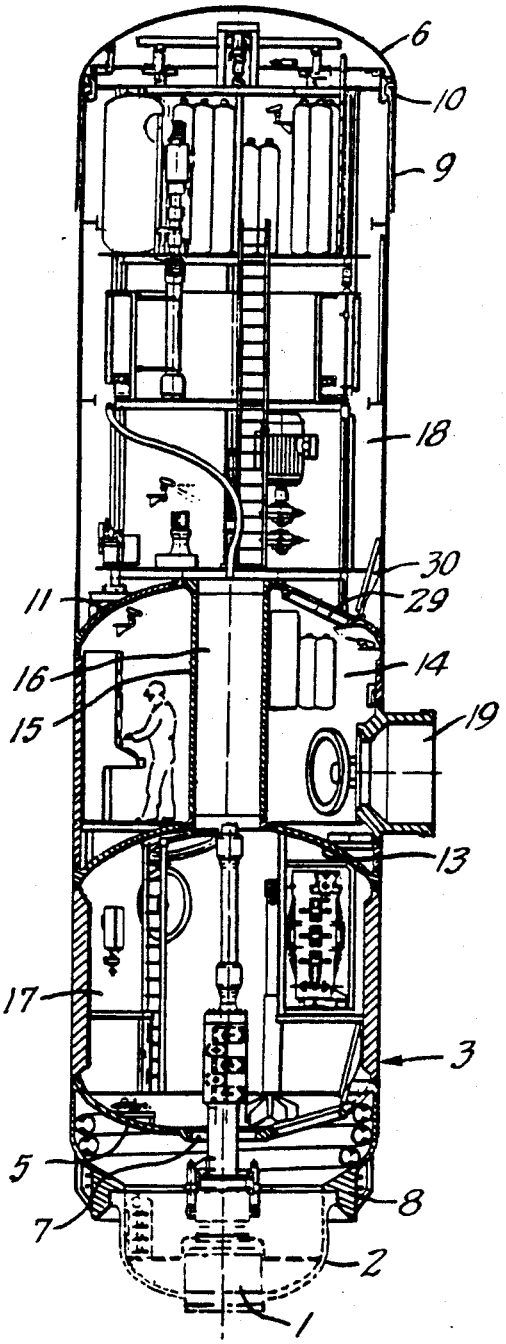
FIG. 2 shows a section through a mono-atmospheric chamber module according to the invention, with some equipment included.
Figure 3:
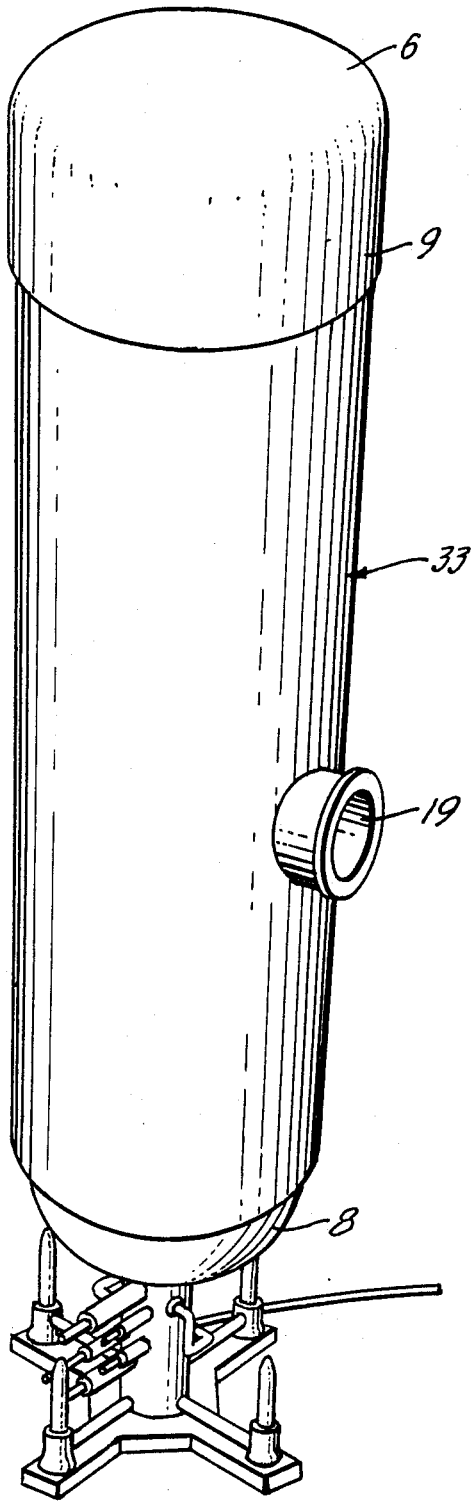
FIG. 3 shows the chamber module in FIG. 1 viewed from the outside and in perspective, placed on a Christmas tree.

In FIG. 2 the chamber module 3 is shown in a detailed section, where the chamber module is shown mounted on the supporting part 2 on the top of the Christmas tree 1.

In the description in the following of the new chamber module, special reference shall be made to FIG. 4, 5 and 6, which show each room in the chamber module in FIG. 2 in a larger scale.

The cylinder mantle 4 is welded together of three main elements, namely a lower mantle element 4-1, a middle mantle element 4-2 and an upper mantle element 4-3. The lower base-end 5 is welded on to the mantle element 4-1 with a transition ring 20 as a spacer. The base-end 13 is welded onto the mantle elements 4-1 and 4-2 by means of an intermediate ring 21 and similarly, the base-end 11 is welded onto the mantle-elements 4-2 and 4-3 by means of an intermediate ring 22.

The upper mantle element 4-3 is finished off with a seat ring 23 welded onto it. The sealing collar 8 is welded onto the lower intermediate ring 20 and is designed with an intake 24 with an internal, circumscribing seat surface 25 which is in contact with the upper rim of the cup-formed supporting part 2 (FIG. 4).

Figure 4:
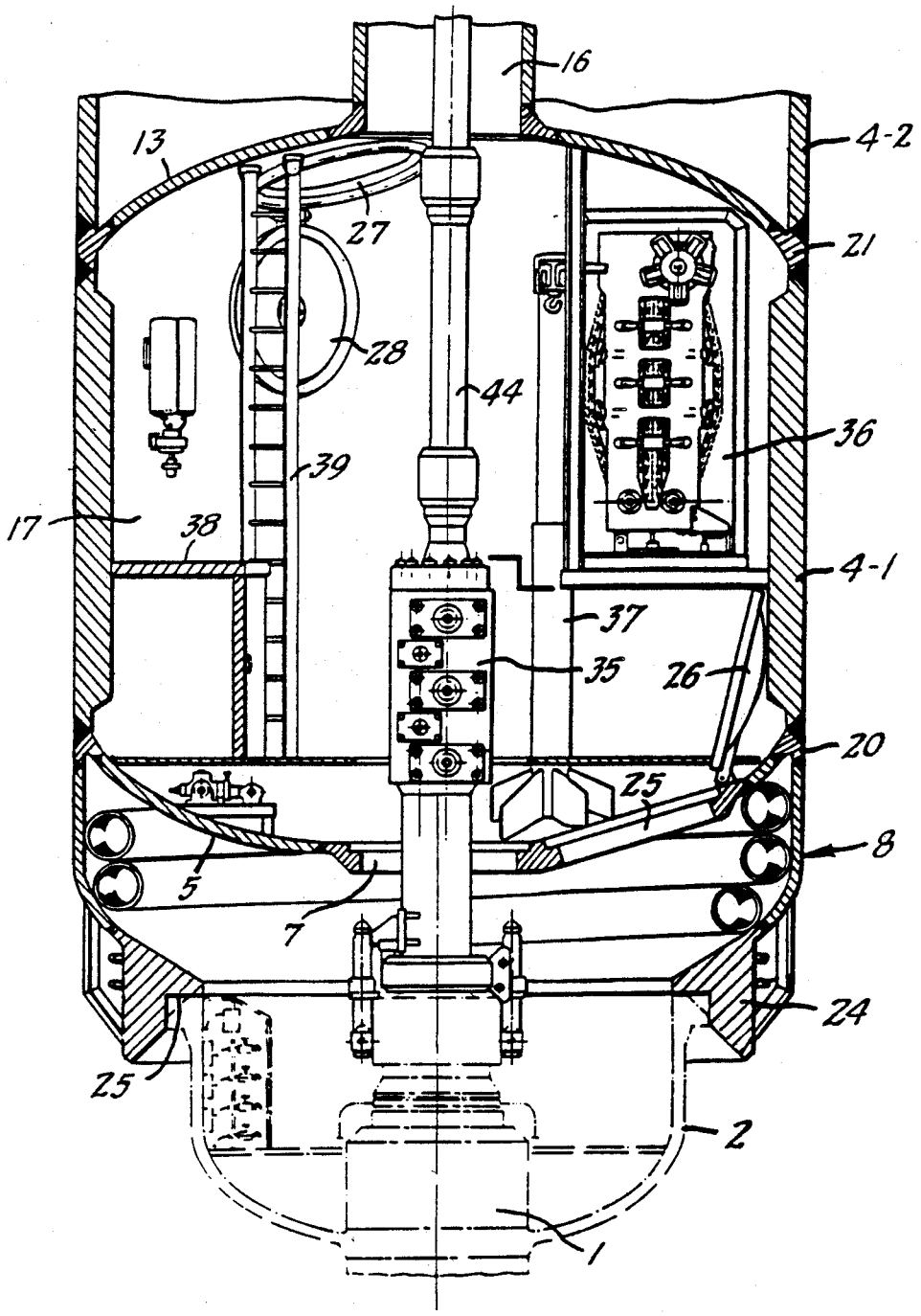
FIG. 4 shows in larger scale a section through the lower part of the chamber module in FIG. 2 and 3.
Figure 5:
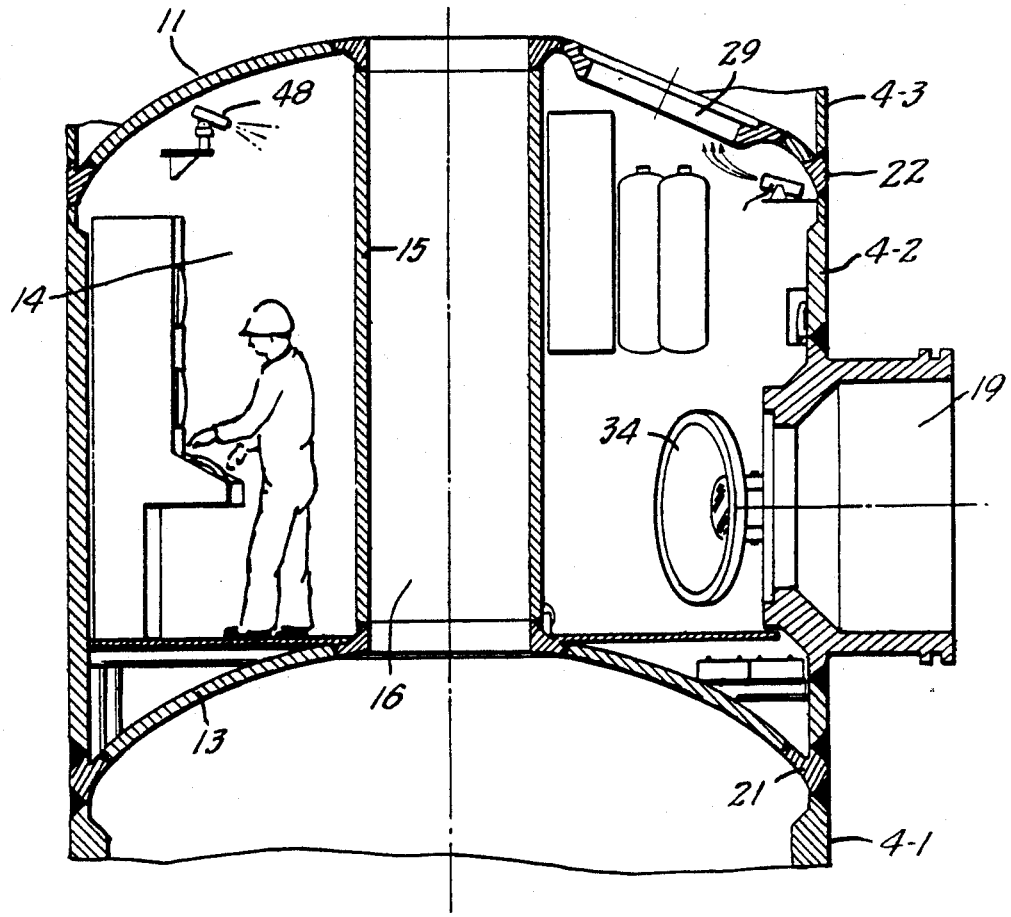
FIG. 5 shows a section of the chamber module in FIG. 2 and 3 in larger scale, and shows the personnel chamber.

In addition to the opening 7 in the base-end 5, there is shown in FIG. 2 and 4 a hatch opening 25 with associated hatch 26.

In the base-end 13, a hatch opening 27 with associated hatch 28 is shown. In the base-end 11, a hatch opening 29 with associated hatch 30 (FIG. 2 and FIG. 6) is shown.

The upper base-end 6 is welded onto a seat support ring 31. A cylindrical body, which forms the previously described cylindrical wall extension 9, is welded onto this seat support ring, 31 which rests, as shown in FIG. 6, against the seat ring 23. Between them, as indicated, a suitable washer 32 is placed.

Figure 6:
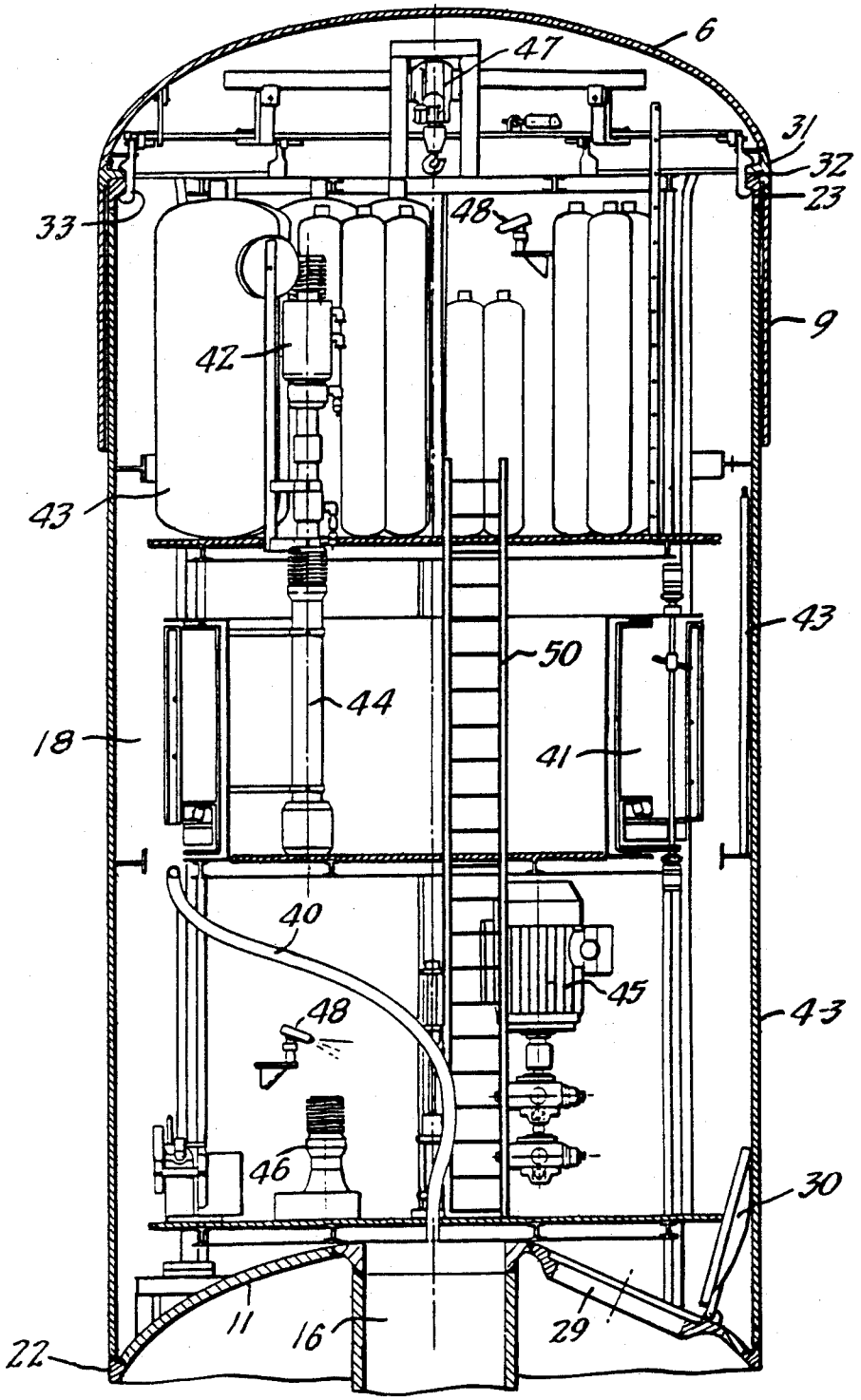
FIG. 6 shows an upper part of the chamber module in FIG. 2 and 3, in an enlarged section through the room situated above the personnel chamber.

In FIG. 6 the detachable base-end 6 is shown locked to the cylinder mantle 4 with the help of a locking device which includes locking claws 33. These can be released by means of a suitable mechanism, which is remotely controlled from the personnel/control chamber 14. In the conditions which are shown in FIG. 2-6, the locking arrangement (locking claws 33) will of course be either opened or disconnected, and in the drawings they are only shown in the locked position, to demonstrate this.

It will be noticed that the wall thickness in the mantle elements varies, since the mantle element 4-1 is thicker than the mantle element 4-2, which in turn has greater thickness than the mantle element 4-3. The reason for this is that it is desirable to attain the lowest possible point of gravity for the chamber module for stability reasons.

The access opening 19 to the personnel/control chamber 14 can be closed by a hatch 34. These hatches are shown opened in the drawing figures, but naturally they will be closed when the chamber module is mounted on to the Christmas tree. This concerns mainly the hatch 34, but the hatches 28 and 30 will also normally be closed when personnel are inside the control chamber.

In FIG. 2 and 4-6, the same equipment is shown which shall be described in more detail in the following. In the lower room 17 a blow-out preventer 35 is shown, which is mounted onto the top of the Christmas tree 1. Further, an injector head 36 is shown, a lifting device 37 for the blow-out preventer, and a work bench 38. A ladder up to the hatch opening 27 is arranged. This ladder is indicated by 39.

In the upper room 18 a so called "goose neck" 40 is shown, a tubing drum 41 (with a vertical axis), an injector head 42 for grease, various tanks 43, polished rods 43 sections 44, which are used during the construction of a sluice (wire sluice and/or bar sluice) and a hydraulic power package 45 plus a transition part which belongs to the blow-out preventer. This list of equipment is not meant to be exhaustive, but is only provided to exemplify what kind of equipment can be installed in the chamber module's upper room 18. Moreover, FIG. 4 shows how a wire sluice is mounted on to the blow-out preventer 35. In FIG. 4 the wire sluice is indicated by the reference number 44. The wire sluice stretches up through the passage 16 and further up into the room 18, but is not shown in FIG. 5 and 6.

At the very top of the room 18 there is a hoisting crane 47 which is used for handling of the equipment. Further, T.V. cameras 48 are shown, and a ventilation fan 49. A ladder 50 is also shown in the upper room 18. Concerning the previously mentioned goose neck 40, this is used for control and guidance of the coiled-up tubing on the drum 41, when this tubing is to be led down through the passage 16 and down into the well.

In a preferred practical embodiment, the new mono-atmospheric chamber module will have an outer diameter of about 3.8 m and a length of about 15 m. Understandably, this length or height will provide enough space inside the chamber module, especially considering the installation of the necessary wire or bar sluice 44. Personnel will stay inside the closed-off personnel chamber 14 and from there, control all work operations. In the case of a possible dangerous over-pressure in the chamber module, the hat, that is, the upper end-base 6 with the cylindrical wall extension 9, will raise itself, thus achieving a quick pressure drop. This gives security against the possibility of explosion of the chamber module and also provides security for personnel situated in the otherwise pressure-secure personnel/control chamber 14.

When necessary, personnel can of course enter rooms 17 and 18, whilst observing the necessary security measures (setting up of double barriers in the Christmas tree).

When maintenance jobs are to be carried out, the chamber module is placed on the Christmas tree, by, for example, the following procedure: the control chamber is closed and filled with atmosphere air. Hatch 7 is closed. There are no personnel in the chamber. The chamber module is placed on the cup-formed supporting part 2. This can be carried out by means of suitable equipment from a surface vessel or with the use of a submarine which is equipped to be able to transport and install the module. Safety precautions are taken, for instance with the help of T.V. cameras, to make sure that the module is accurately installed, after which the discharge of water begins.

The pressure in the rooms 17, and 18 is equalized with the pressure in the control chamber 14. Personnel can now enter the chamber 14 through the access opening 19. The personnel can enter from a submarine which couples itself on or from a diving bell. The usual transfer procedure is followed. Before any personnel enter rooms 17, 18 the conditions in these are checked, particularly the air conditions.

After the necessary maintenance work is carried out the personnel leave the chamber 14 through the opening 19 and enter a diving bell or a coupled on submarine. The hatch 7 is closed and water is permitted to flow into the room which is formed by the module's lower part and the cup-formed supporting part 2. After the balance of pressure is restored, the chamber module is removed, for instance by means of a connected underwater vessel, or by means of suitable lifting apparatus on a surface vessel. During transportation of the new chamber module, the detachable top is secured by means of the locking device 33.

According to the invention, the chamber module can be modified in many ways in relation to the embodiment shown and described. So, for instance, the personnel/control chamber can be arranged as an eccentrically placed chamber in the module, where preferably the lower opening in the chamber module's end-base is correspondingly eccentrically placed in the opposite direction so that the chamber module's full height can be utilized.

The personnel/control chamber can also be designed as an independent pressure-resistant unit inside the chamber module.

The personnel/control chamber can also have several floors. A solution where for example the personnel/control chamber is situated at the very top of the chamber module can also be considered, but such a solution will naturally mean that the chamber module's internal height cannot be fully utilized for equipment and execution of work operations.

The shown and described chamber module is considered at the present stage of development to be the most favorable embodiment.

We claim:

1. A mono-atmospheric chamber module to be mounted on top of an underwater Christmas tree in a well-head, for keeping equipment and personnel at surface conditions during execution of operations, said chamber comprising:

(a) a mainly oblong cylindrical mantle having a lower and upper base-end, said lower base-end having a first opening therein for tight engagement with the top of said Christmas tree, said mainly oblong cylindrical mantle having a second opening therein for personnel;

(b) a pressure resistant personnel chamber positioned inside said mainly oblong cylindrical mantle and directly connected to said second opening;

(c) said upper base-end being detachable from said oblong cylindrical mantel and having a cylindrical wall extension which extends down the outside of said cylindrical mantle; and (d) a sealing collar surrounding said first opening and attached to said lower base-end, said sealing collar for engagement with a cup shaped support member on top of said Christmas tree.

2. The mono-atmospheric chamber module according to claim 1 further comprising a locking device for locking the upper base-end to the cylindrical mantle.

3. The mono-atmospheric chamber module according to claim 1 wherein the personnel chamber consists of a cylindrical segment of the module and said personnel chamber having a central, through-going passage which connects to a lower module room underneath the personnel chamber and an upper module room above the personnel chamber and wherein the first opening is centrally placed in said lower base-end.

4. The mono-atmospheric chamber module according to claim 3 wherein the lower module room contains a blow-out preventer.

5. The mono-atmospheric chamber module according to claim 3 wherein the upper module room above the personnel chamber contains a goose neck, a tubing drum, an injector head, tanks, polished rods, sections for slicing, a hydraulic power package, and a hoist crane.

6. The mono-atmospheric chamber module according to claim 1 further comprising a drum for coiling up a tubing wherein said drum has a vertical axis, said tubing for insertion down into the well to establish a course of circulation in a production hole.

7. The mono-atmospheric chamber module according to claim 1 wherein the wall of said cylindrical mantle is thickest at the end of the module nearest said lower base-end.

* * * * *